US011136869B2

(12) United States Patent
Semenov et al.

(10) Patent No.: US 11,136,869 B2
(45) Date of Patent: Oct. 5, 2021

(54) METHOD FOR DETECTING A FRACTURE POSITION IN A WELL (VARIANTS)

(71) Applicant: Schlumberger Technology Corporation, Sugar Land, TX (US)

(72) Inventors: Sergey Vladimirovich Semenov, Kurgan (RU); Anatoly Vladimirovich Medvedev, Sugar Land, TX (US); Fedor Nikolaevich Litvinets, Biysk (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 213 days.

(21) Appl. No.: 16/314,220

(22) PCT Filed: Jul. 1, 2016

(86) PCT No.: PCT/RU2016/000408
§ 371 (c)(1),
(2) Date: Dec. 28, 2018

(87) PCT Pub. No.: WO2018/004370
PCT Pub. Date: Jan. 4, 2018

(65) Prior Publication Data

US 2019/0218898 A1 Jul. 18, 2019

(51) Int. Cl.
*E21B 43/26* (2006.01)
*E21B 47/00* (2012.01)
*E21B 47/10* (2012.01)

(52) U.S. Cl.
CPC ..... *E21B 43/26* (2013.01); *E21B 47/00* (2013.01); *E21B 47/10* (2013.01)

(58) Field of Classification Search
CPC ..... E21B 43/26; E21B 47/00; E21B 47/10; E21B 47/06
See application file for complete search history.

(56) References Cited

U.S. PATENT DOCUMENTS 4,141,843 A * 2/1979 Watson ..... C09K 8/206 507/207
4,530,402 A * 7/1985 Smith ..... C09K 8/424 166/285

(Continued)

FOREIGN PATENT DOCUMENTS

EP 2670949 B1 8/2015
RU 2439310 C1 1/2012

(Continued)

OTHER PUBLICATIONS

International Preliminary Report on Patentability issued in International Patent Appl. No. PCT/RU2016/000408 dated Jan. 10, 2019; 11 pages.

*Primary Examiner* — Steven A MacDonald

(57) ABSTRACT

The positions of hydraulic fractures may be detected during multistage reservoir stimulation operations. Fracturing fluid is injected into a well at a pressure above the fracturing pressure to produce at least one hydraulic fracture. Then, a marker slug is injected into the well. Next, additional fracturing fluid is injected into the well. When the marker slug enters at least one of the hydraulic fractures, a detectable pressure response is observed, and the position of a hydraulic fracture may be detected from the volume of fracturing fluid injected after injection of the marker slug. The marker slug is a fluid that has a viscosity and/or density that is different from the fracturing fluids injected before and after the marker slug. This technique may be combined with other well operations, such as plugging at least one hydraulic fracture or creating at least one new hydraulic fracture.

24 Claims, 2 Drawing Sheets

(56) References Cited

U.S. PATENT DOCUMENTS

| | | | | |
|---|---|---|---|---|
| 6,148,917 | A * | 11/2000 | Brookey | C09K 8/02 166/301 |
| 8,369,183 | B2 | 2/2013 | Savary-Sismondini et al. | |
| 9,121,272 | B2 | 9/2015 | Potapenko et al. | |
| 2004/0103376 | A1* | 5/2004 | Pandey | E21B 41/00 715/211 |
| 2012/0193092 | A1* | 8/2012 | Qu | E21B 47/107 166/255.1 |
| 2013/0062066 | A1* | 3/2013 | Broussard | E21B 43/26 166/305.1 |

FOREIGN PATENT DOCUMENTS

| | | | |
|---|---|---|---|
| RU | 2531775 | C1 | 10/2014 |
| SU | 133022 | A1 | 11/1959 |
| WO | 2012087796 | A2 | 6/2012 |
| WO | 2014055931 | A1 | 4/2014 |
| WO | 2014193577 | A1 | 12/2014 |

* cited by examiner

METHOD FOR DETECTING A FRACTURE POSITION IN A WELL (VARIANTS)

FIELD OF THE INVENTION

The invention relates to stimulation of an underground reservoir using hydraulic fracturing operation, particularly, to methods for detecting hydraulic fractures positions during multizone reservoir stimulation.

PRIOR ART

Prior art solutions describe microseismics for characterization of hydraulic fractures, for example, U.S. Pat. No. 8,369,183 (Schlumberger Technology Corporation), WO2014055931 (Halliburton Energy Services), etc.

There are known solutions describing the use of acoustic tools and computer models for description of hydraulic fractures geometry, for example, WO2012087796 (Schlumberger Canada limited).

Also, known solutions employ temperature measurements for characterization of hydraulic fractures, for example, WO2014193577 (CONOCOPHILLIPS COMPANY).

Accordingly, there is a need in prior art for a simple method for detecting an open hydraulic fracture position during multizone reservoir stimulation with the use of simple and available measuring instruments.

SUMMARY OF THE INVENTION

The present disclosure describes a new approach to detecting hydraulic fractures positions during multizone reservoir stimulation. The method is based on local changes in the viscosity and/or density of fluid injected into a well.

In certain embodiments, this disclosure relates to a method for detecting a hydraulic fracture positions in a well. According to the claimed method, fracturing fluid is injected into a well at a pressure above the fracturing pressure to produce at least one hydraulic fracture. After this, a marker slug is injected into the well. Further, the fracturing fluid is re-injected into the well. When the marker slug enters at least one of the hydraulic fractures, a detectable pressure response is observed, and the position of hydraulic fracture is determined from the volume of fracturing fluid injected after the marker slug. The marker slug is a slug (portion) of fluid differing in the viscosity and/or density from the fracturing fluids injected before and after the marker slug.

In other embodiments, this disclosure relates to a method for detecting a hydraulic fracture position in a well in conjunction with operations of plugging (colmatage) of at least one hydraulic fracture out of already existing hydraulic fractures.

In yet another embodiments, this disclosure relates to a method for detecting a hydraulic fracture position in a well in conjunction with operations of placement of at least one additional (new) hydraulic fracture within a new reservoir stimulation zone.

Other aspects of this invention will become evident from the following description and appended claims.

DESCRIPTION OF EMBODIMENTS

When carrying out multistage hydraulic fracturing operations at oil and gas wells, it is required to understand where exactly fluid is injected. This disclosure describes a method for detecting a hydraulic fracture in a well having one or several hydraulic fractures that have been initiated in a productive reservoir and determining which of the existing hydraulic fractures is receiving fluid at a specific point in time.

This disclosure is based upon basic laws of fluid flow through objects of different geometry (a pipe, a rectangular slot, etc.). The main idea described in the above basic laws is that the pressure drop during liquid flow through a pipe or rectangular slot depends on the fluid viscosity and density.

The Darcy-Weisbach formula for pressure difference during flow of viscous fluid through a pipe of diameter Dr is known from hydrodynamics $$\Delta p_{fric} = \lambda \frac{l}{D_r} \frac{\rho w_0^2}{2} \tag{1}$$

$$\Delta p_{rp} = \lambda \frac{l}{D_r} \cdot \frac{\rho w_0^2}{2}$$

The Darcy-Weisbach formula (1) describes the relation among the friction pressure ($p_{fric}$) of fluid flowing in a fracture, the fluid viscosity (accounted for by the hydrodynamic coefficient $\lambda$), the fluid density ($\rho$) and the linear velocity ($\omega_0$).

When fluid flows through a pipe of constant diameter (a casing), the flow through a local restriction (for example, through the perforation openings in a casing or the fracturing sleeve openings) passes into the volume of hydraulic fracture. If we select two points on different sides of the restriction location, the pressure difference between these two points is described by formula (1). As is obvious, a drastic change in either of the formula coefficients (the fluid density and/or viscosity) causes a change in upstream pressure at constant linear velocity.

As this takes place, a decrease in the pressure difference according to formula (1) causes a negative pressure response, while an increase in the pressure difference according to formula (1) (density increase in a slug (pulse)) reveals itself in the form of a positive pressure response in the well.

Figure 1:
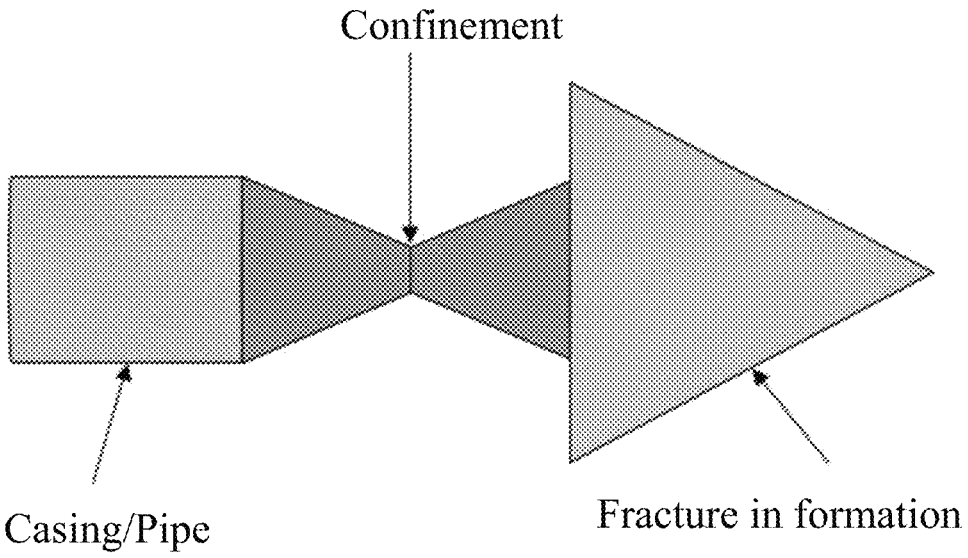
FIG. 1 schematically illustrates passage of fluid flow into a perforation or a frac sleeve opening through a restriction.

As applied to stimulation of oil and gas wells, the fluid flow through a fracture is a process being technologically identical to fluid flow through a narrow rectangular slot (FIG. 1). The fluid flow through a perforation or a frac sleeve (port) opening is identical to the flow through a local restriction.

In general, the embodiments of the method for detecting a hydraulic fracture position in a well can be presented by the following sequence of operations:

1. Injecting a fracturing fluid into a well that has several open fracturing sleeves (ports) or perforation intervals, where a hydraulic fracture can be initiated.
2. Exceeding the initiation pressure and, thus, producing a hydraulic fracture.
3. Injecting a marker slug with viscosity and/or density differing from those of fracturing fluid.
4. Injecting the fracturing fluid to displace the marker slug up to perforations or fracturing sleeves.
5. Detecting a pressure response.

6. Comparing the time point of observed pressure response with the volume of injected fracturing fluid after the marker slug.

7. Based on the volume of injected fracturing fluid, detecting the location of perforation interval or the position of respective fracturing sleeve, where the fracture, to which the marker slug was delivered, was initiated (item 4).

An essential stage of this disclosure is injection of a "marker slug" into a well. In the oil and gas industry practice, a slug being stably distinguishable from other fluid in its physical properties is referred to as the fluid slug. A characteristic feature of the "fluid slug" can be fluid density, fluid viscosity, concentration of additives, etc. A fluid slug in a well or pipe can be created with the use of standard equipment by combining fluid flows with substantially different properties in the same pipe. For example, when using the flow-channel hydraulic fracturing technique, "clean slugs" and "dirty slugs" that are maintained during transportation to the perforation openings are alternately injected into the casing. "Dirty slugs" are the proppant-laden viscous fluid slugs, while "clean slugs" are the proppant-free fluid slugs. The use of "fluid slugs" for reservoir treatment and injection of fluid slugs (portions) with different pH are also known.

In the context of the disclosed method, the "marker slug" concept means a fluid slug to be injected into a wellbore showing physical properties different from those of the remaining fracturing fluid. The "marker" feature means that the composition and size of a slug are such that slug delivery into a well causes no substantial changes in the geometry and positions of hydraulic fractures. Such "marker slug" is a source of information when detecting hydraulic fractures position. In other words, injection of "marker slug" cannot affect the positions and geometry of hydraulic fractures produced before this slug. A person of ordinary skill in the oil and gas industry will appreciate the limitations to be applied when a "marker slug" is injected into a well so that it does not cause substantial changes in the hydraulic fracture geometry or fracture conductivity. In particular, effective viscosity and/or density of fluid are physical properties that distinguish the marker slug from fracturing fluid slugs.

According to the embodiments of this disclosure, the marker slug fluid has a viscosity that is substantially different from the fracturing fluid viscosity. For the Newtonian fluids (water, saline solutions), the fluid viscosity is independent on the flow shear rate; it depends on temperature to a greater extent. The non-Newtonian fluids demonstrate different behavior. If a non-Newtonian fluid (where viscosity varies with flow shear rate) is injected, this leads to a decrease in the effective viscosity of fluid. Such fluids are characterized by a dependency graph of viscosity (cP) versus shear rate (units of $s^{-1}$). Many well-working fluids are based on viscosified water-soluble polymers solutions referred to the class of non-Newtonian fluids (in particular, shear-thinning fluids). This characteristic of fluid rheology should be taken into account in consideration of the substantial feature of "fluid viscosity". By viscosity we mean kinematic (or dynamic) viscosity measured just in the "bottleneck" or "high shear rate" conditions.

In some embodiments of this disclosure, the viscosity of marker slug fluid is 10 (or more) times as great as the viscosity of fracturing fluid. Such difference in viscosities is achieved when the low-viscous (standard) fracturing fluid is selected as a fracturing fluid, while the fluid thickened by a high polymer concentration is selected for a marker slug. Generally, a polymer-viscosified fluid pertains to the class of non-Newtonian fluids. As a variant of viscous fluid, a water-soluble polymer solution is additionally crosslinked by a crosslinker. In the oil industry practice, thickened fluids with viscosity of hundreds and thousands of centipoises can be produced.

In some embodiments of this disclosure, a fluid for marker slug is a viscosified oil-based fluid. Therewith, the oil-based fluid is poorly miscible with aqueous fracturing fluid, which allows maintaining a high viscosity difference between fracturing fluid and an oil-based marker slug.

In some embodiments of this disclosure, the viscosity of marker slug fluid is 10 (or more) times as small as viscosity of fracturing fluid. Such combination of fluids will be produced if water viscosified with a water-soluble polymer (water-swellable polysaccharides, polyacrylamide polymers, carboxymethyl cellulose and other thickeners) is used as a fracturing fluid, while, by contrast, a marker slug is an aqueous fluid without thickening additives ("non-viscous slug").

According to embodiments of this disclosure, the marker slug fluid has a higher density as compared to the fracturing fluid. An intended increase in fluid density is known from the drilling or hydraulic fracturing practice (to ensure the desired pressure of hydrostatic fluid column, which is directly proportional to the height of fluid column and fluid density). To increase fluid density, high-density particles are added. For example, weighting agents are presented by such minerals as barite, hematite and other weighting materials. In practice, density of fluids can be increased by 1.1-2 times.

In some embodiments of this disclosure, the density of marker slug is considerably lower than the density of fracturing fluid slug. This is achieved by introducing a lightweight material. For example, a lightweight material is an additive for reducing the density of marker slug, such as cenospheres or polymeric hollow spheres.

In some embodiments of this disclosure, the marker slug fluid differs from the fracturing fluid to the higher side both in the density and viscosity (due to the additives of weighting or lightweight agents). For example, the marker slug will have an increased viscosity (by 10 times and more) and an increased density (by 1.1 times and more).

In some embodiments of this disclosure, fibers at concentration above 0.5% are added into the marker slug fluid. It is known that the addition of fibers into one or both interfacial fluids increases stability of the interface between two interfacial fluids (the marker slug fluid and the fracturing fluid). This maintains the viscosity contrast of the marker slug flowing through the pipe to the fracture entry.

After formation of the marker slug, generation of pressure response may be conceived of as reaction to passage of the marker slug through the bottlenecks of fluid flow.

When the marker slug passes through an open hydraulic fracture zone, a pressure response occurs. The pressure response propagates upwards the fluid filling the well. The pressure response (a positive or negative pressure gain) is recorded by pressure transmitters located in the well or on the surface (at the wellhead).

Different positions in the well can be selected as the locations of one or more recording pressure transmitters: for example, at the wellhead, or in the wellbore. Since the pressure response (a pressure peak) occurs as the fluid marker slug passes through the hydraulic fracture, such response is easily recorded in the pressure record diagram, if no other events having influence on the downhole pressure (such as fracture closure, pump shutdown, packer setting, etc.) take place. Therefore, an embodiment of the method provides for sequential injection of fracturing fluid and a marker slug at a constant fluid flow rate ($m^3/s$). It is the constant fluid flow rate (continuous operation of hydraulic fracturing pumps) in the pressure record diagram that enables detecting the pressure response related to passage of the marker slug.

The pressure response amplitude depends on the location of pressure transmitter, the level of noise in the well and a method for recording and processing the pressure signals. In most cases, a useful signal identifying the event of marker slug passage into a hydraulic fracture can be above 0.1 bar, and its value is reliably recorded by pressure transmitters.

Figure 2:
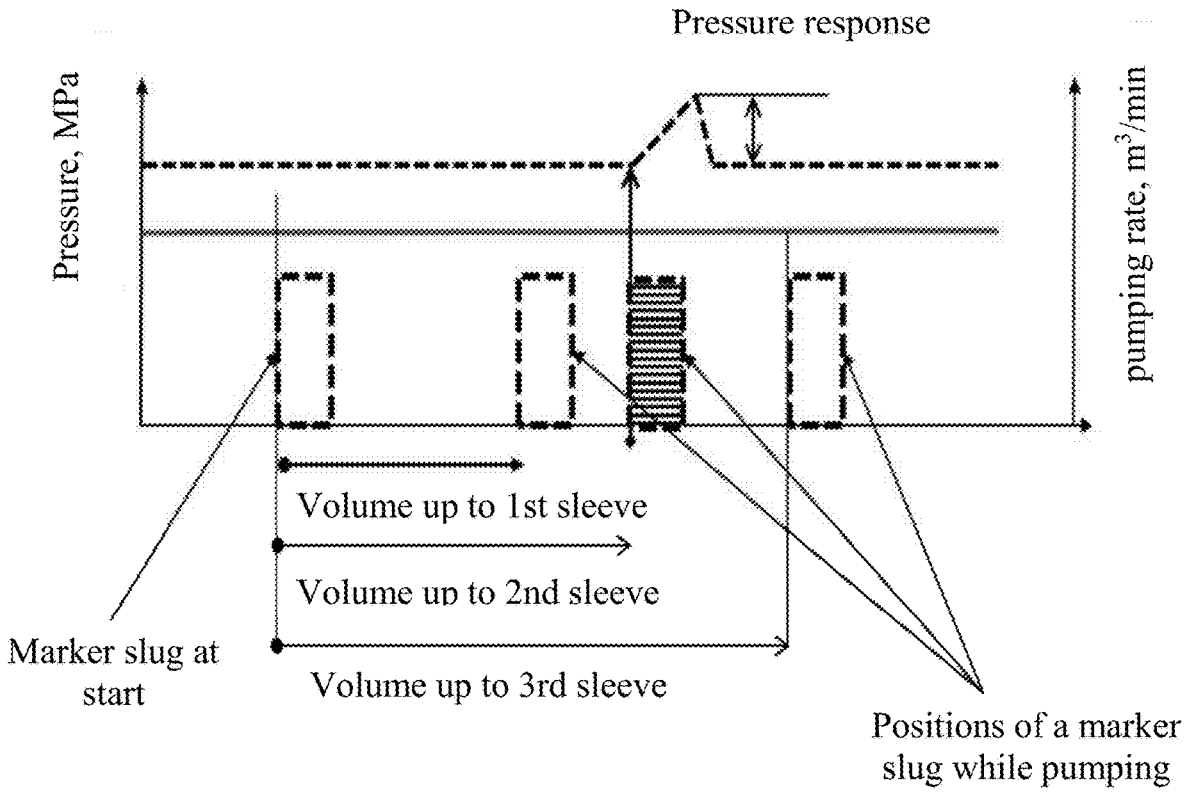
FIG. 2 depicts a diagram of exemplary embodiment of the method.

At the instant when the pressure response caused by the marker slug passage is identified, the volume of fracturing fluid injected after the marker slug is measured by means of a flow meter. When the diameter (section area) of pipes and the constant injection rate of fracturing fluid are known, this volume of fracturing fluid indicates the coordinate of marker slug location near the hydraulic fracture being detected and, respectively, the fracture coordinate with reference to the wellhead (FIG. 2).

The embodiments of the method are distinguished for different well completion options (i.e. options for producing and maintaining a hydraulic fracture). According to one completion option, perforation clusters (zones) corresponding to reservoir zones that need stimulation are produced in an inclined or horizontal well using perforation tools. Then, using surface pumps, fracturing fluid is injected into the well at a pressure exceeding the hydraulic fracturing pressure of the reservoir, which results in opening of one or more hydraulic fractures. Since the mechanical stresses in the reservoir stimulation zone differ for different perforation clusters, the hydraulic fractures are initiated and propagate into the reservoir with varying efficiency.

According to another completion option, one or more fracturing sleeves are arranged on the pipe in an inclined or horizontal well. Fluid injection through the fracturing sleeves (or fracturing ports) is different from injection through conventional perforation openings made in a casing. The fracturing sleeves render unnecessary the operation of forming perforation openings using a system of perforation charges. Instead of this, a fracturing sleeve has ready-made openings. Furthermore, the industry employs more suitable versions of sleeves, wherein a set of openings can be not only opened, but also closed at a desired depth to restrict flow communication between the reservoir and the tubing. As the fracturing fluid pressure increases (the injection stage), the hydraulic fracturing of the rocks (formation of fractures) proceeds near the fracturing sleeve. However, as this takes place, newly-formed fractures are produced at the soft rock places, and these places may be not coincident with the positions of fracturing sleeve openings (the hydraulic fracture is shifted with respect to the fracturing sleeve). With such configuration, it is also expedient to detect the actual position of the hydraulic fracture.

In the above described well completion options comprising formation of hydraulic fractures, the bottlenecks (restrictions) for fracturing fluid communication appear. These can be perforation openings of perforation clusters or a hydraulic fracture zone near the wellbore. An increased flow shear rate is indicative of such a bottleneck.

Therewith, perforation openings in pipes can be made with different modifications. Perforation openings for fluid inlet can be produced by the methods known in the industry.

In some embodiments of this disclosure, the method for detecting a hydraulic fracture position in a well is combined with other well operations such as, for instance, the placement of a new fracture (refract), for example, in the following sequence in accordance with the selected injection schedule: or plugging of the existing hydraulic fractures.

(a) injecting a fracturing fluid into a well having at least one hydraulic fracture and an initiation zone of new hydraulic fracture;

(b) increasing pressure above the fracturing pressure and producing at least one new hydraulic fracture;

(c) injecting a marker slug into the well;

(d) injecting a fracturing fluid into the well.

In so doing, when the marker slug enters at least one of the hydraulic fractures, a detectable pressure response is observed, and the position of a hydraulic fracture is detected from the volume of fracturing fluid injected at stage (d).

In the multizone reservoir stimulation practice, need arises for redirection of working fluid flows from one hydraulic fracture to another. To accomplish this, the required well section is isolated by injecting an "isolation pill" or "blocking pill" or "diversion material".

Therefore, in some embodiments of this disclosure, the method for detecting a hydraulic fracture position in a well is combined with other well operations such as, for instance, plugging of already existing fractures, for example, in the following sequence in accordance with the selected injection schedule:

(a) injecting a fracturing fluid into a well at a pressure above the fracturing pressure and producing at least one hydraulic fracture;

(b) providing plugging of at least one hydraulic fracture in the well;

(c) injecting a fracturing fluid into the well at a pressure above the fracturing pressure and producing at least one new hydraulic fracture;

(d) injecting a marker slug into the well;

(e) injecting a fracturing fluid into the well.

When the marker slug enters at least one of the hydraulic fractures, a detectable pressure response is observed, and the position of a hydraulic fracture is detected from the volume of fracturing fluid injected at stage (e).

Rather long time intervals can be provided between stages (a) and (b) for execution of well operations.

Plugging of hydraulic fracture(s) at (b) stage is performed by any known method, for example, using degradable materials.

The embodiments of this disclosure allow detecting hydraulic fractures positions that receive fracturing fluid without engagement of complex downhole equipment, distributed pressure transmitters, load, temperature, etc. The pressure response is measured using a standard pressure transmitter available in the well.

EXAMPLES

Example 1

The example demonstrate injection of a marker slug, occurrence of pressure response recorded at the wellhead when the marker slug enters a hydraulic fracture, and then, the hydraulic fracture position detection in the well from the volume of injected fluid.

FIG. 2 shows passage of a viscous marker slug through a section of horizontal well with several fracturing sleeves (ports). The well has a constant pipe diameter. Surface-based pumps (not shown) create a constant flow rate of fracturing fluid that enters the well and is consumed through one or more open hydraulic fractures. The locations of three fracturing sleeves (the 1st, 2nd and 3rd sleeves) are designated.

At a certain point of time, a device for supplying fracturing fluid into the well is switched to a tank containing viscous fluid (the formed "marker slug"). In each particular case, the viscosity of marker slug is within the range of values that exceeds the viscosity of fracturing fluid by 10 to 100 times. Once the marker slug is introduced, the fluid supply valve is switched to supply of the previous fracturing fluid.

During transportation of viscous marker slug along the wellbore, the marker slug remains in the form of a single slug between two low-viscous fracturing fluids.

Since injection of fluids proceeds at a pressure above the hydraulic fracturing pressure (P>Pfrac) and at a constant fluid flow rate, then the instant (time) of marker slug passage near one of the fracturing sleeves is proportional to the volume of injected fracturing fluid after injection of marker slug. Passage of marker slug through a bottleneck near the fracturing sleeve causes a local change in the pressure difference due to flow restriction, and this change in the fluid flow regime reveals itself in the form of a positive pressure response, which is registered by means of a pressure transmitter located at the wellhead.

Example 2

In the course of multistage hydraulic fracturing at one of the wells in Russia, a sequence of operations was carried out for detecting a hydraulic fracture position in the well. To execute the stage (inject a marker slug), a fluid in the volume of 2 $m^3$ (a crosslinked gel with a gelling agent concentration of 7.2 $kg/m^3$) with the viscosity 460 times exceeding that of the fracturing fluid at other stages was used. The marker slug was displaced by displacement fracturing fluid (a linear gel with the gelling agent concentration of 3.6 $kg/m^3$) at a constant fluid flow rate. The volume of displacement fracturing fluid up to receiving a pressure response of 60 bars was 16 $m^3$, which corresponded to the volume up to fracturing sleeve No. 5.

Example 3

When carrying out multistage hydraulic fracturing according to Example 2, a marker slug with the viscosity 460 times exceeding that of the fracturing fluid at other stages was injected.

To execute the stage (inject a marker slug), a fluid in the volume of 2 $m^3$ (a crosslinked gel with a gelling agent concentration of 7.2 $kg/m^3$ and weighting agent (barite) added to achieve the marker slug's effective density of 1,250 $kg/m^3$) with the viscosity 460 times exceeding that of the fracturing fluid at other stages was used. The marker slug was displaced by displacement fracturing fluid (a linear gel with the gelling agent concentration of 3.6 $kg/m^3$) at a constant fluid flow rate. The volume of displacement fracturing fluid up to receiving a pressure response of 80 bars was 15.4 $m^3$, which corresponded to the volume up to fracturing sleeve No. 6.

It is apparent that the above embodiments shall not be regarded as a limitation of the patent claims scope. It is clear for a person skilled in the art that it is possible to introduce many changes to the technique described above without departing from the principles of the claimed invention.

The invention claimed is:

1. A method for detecting a hydraulic fracture position in a well, comprising: (a) injecting a fracturing fluid into a well at a pressure above a fracturing pressure and producing at least one hydraulic fracture; (b) injecting a liquid marker slug into the well; (c) injecting the fracturing fluid into the well behind the marker slug; (d) when the liquid marker slug flows through a perforation or a frac sleeve, detecting a pressure response and measuring a volume of the fracturing fluid injected at stage (c); and (e) determining the position of the at least one hydraulic fracture.

2. The method of claim 1, wherein the marker slug has a different viscosity and/or density than the fracturing fluid at stages (a) and (c).

3. The method of claim 1, wherein the marker slug viscosity is at least ten times higher than the fracturing fluid viscosity.

4. The method of claim 1, wherein the marker slug viscosity is at least ten times lower than the fracturing fluid viscosity.

5. The method of claim 1, wherein the marker slug further comprises solid particles or fibers.

6. The method of claim 1, wherein the marker slug further comprises a weighting material that increases marker slug density or a lightweight material that decreases marker slug density.

7. The method of claim 6, wherein the weighting material comprises barite or hematite.

8. The method of claim 6, wherein the lightweight material comprises cenospheres or hollow polymer spheres.

9. The method of claim 1, wherein a fluid-injection rate at stages (a), (b) and (c) is kept constant.

10. The method of claim 1, wherein the fluid injection at stages (a)-(c) is performed through perforation clusters in casing.

11. The method of claim 1, wherein the fluid injection at stages (a)-(c) is performed through fracturing sleeve openings.

12. The method of claim 1, wherein one or more stages (a), (b), (c) are performed several times in accordance with an injection schedule.

13. A method for detecting a hydraulic fracture position in a well, comprising: (a) injecting a fracturing fluid into a well having at least one hydraulic fracture and an initiation zone of at least one new hydraulic fracture; (b) increasing pressure above a fracturing pressure and producing at least one new hydraulic fracture; (c) injecting a liquid marker slug into the well; (d) injecting the fracturing fluid into the well behind the marker slug; (e) detecting a pressure response when the liquid marker slug flows through a perforation or a frac sleeve and measuring a volume of the fracturing fluid injected at stage (d); and (f) determining the position of the at least one new hydraulic fracture.

14. The method of claim 13, wherein the marker slug has a different viscosity and/or density than the fracturing fluid at stages (a) and (d).

15. The method of claim 13, wherein the marker slug viscosity is at least ten times higher than the fracturing fluid viscosity at stage (a).

16. The method of claim 13, wherein the marker slug viscosity is at least ten times lower than the fracturing fluid viscosity stage (a).

17. The method of claim 13, wherein the marker slug further comprises solid particles or fibers.

18. The method of claim 13, wherein the marker slug further comprises a weighting material that increases the marker slug density or a lightweight material that lowers the marker slug density.

19. The method of claim 18, wherein the weighting material comprises barite or hematite.

20. The method of claim 13, wherein the lightweight material comprises cenospheres or hollow polymer spheres.

21. The method of claim 13, wherein a fluid injection rate at stages (a), (b), (c) and (d) is kept constant.

22. The method of claim 13, wherein fluid injection at stages (a)-(d) is performed through perforation clusters in casing.

23. The method of claim 13, wherein fluid injection-at stages (a)-(d) is performed through fracturing sleeve openings.

24. The method of claim 13, wherein one or more stages of (a), (b), (c) and (d) are performed several times in accordance with an injection schedule.

* * * * *